US010449650B2

(12) United States Patent
Yu

(10) Patent No.: US 10,449,650 B2
(45) Date of Patent: Oct. 22, 2019

(54) WALL POLISHER FOR BUILDING DECORATION

(71) Applicant: Junchao Huang, Jinhua (CN)

(72) Inventor: Yi Yu, Cixi (CN)

(73) Assignee: Junchao Huang, Jinhua, Zhejiang Province (CN)

( * ) Notice: Subject to any disclaimer, the term of this patent is extended or adjusted under 35 U.S.C. 154(b) by 0 days.

(21) Appl. No.: 16/236,354

(22) Filed: Dec. 29, 2018

(65) Prior Publication Data

US 2019/0134769 A1 May 9, 2019

(30) Foreign Application Priority Data

May 4, 2018 (CN) ..... 2018 1 0418629

(51) Int. Cl.

| | |
|---|---|
| ***B24B 23/02*** | (2006.01) |
| ***B24B 7/18*** | (2006.01) |
| ***B24B 47/12*** | (2006.01) |
| ***B24B 55/10*** | (2006.01) |
| ***B24B 55/00*** | (2006.01) |

(52) U.S. Cl.

CPC ..... *B24B 7/182* (2013.01); *B24B 7/186* (2013.01); *B24B 23/02* (2013.01); *B24B 47/12* (2013.01); *B24B 55/00* (2013.01); *B24B 55/102* (2013.01)

(58) Field of Classification Search

CPC ..... B24B 23/02; B24B 55/10; B24B 55/102; B24B 7/182; B24B 7/18; B24B 47/12

USPC ..... 451/359, 354, 456, 453

See application file for complete search history.

(56) References Cited

U.S. PATENT DOCUMENTS 5,679,066 A * 10/1997 Butz ..... B24B 23/03 451/344

5,718,621 A * 2/1998 Turley ..... B24B 23/028 451/342

(Continued)

FOREIGN PATENT DOCUMENTS

| | | |
|---|---|---|
| CN | 0196941 | 10/1986 |
| CN | 202155773 | 3/2012 |

(Continued)

OTHER PUBLICATIONS

First Office Action on for Chinese Counterpart Application 201810418629.6 dated Nov. 20, 2018.

(Continued)

*Primary Examiner* — Robert A Rose

(57) ABSTRACT

This invention discloses a wall polisher for building decoration of this invention, comprising a main body, a housing fixedly arranged on one end of the main body, a slot with an opening towards one end disposed in the housing, a handle fixedly set on the top end face of the main body, standing bases up and down symmetrically disposed on one end face of the main body, a pushing cushion which is fixedly connected to one end face of the main body arranged between the two standing bases; wherein the housing is attached on the rough wall surface with the handle held and the push force applied to the pushing cushion; a dust collecting device which is dismountable disposed on the bottom of the housing; wherein the dust produced during polishing is collected by the dust collecting device, which prevents the dust from spreading to pollute the environment.

6 Claims, 3 Drawing Sheets

(56) References Cited

U.S. PATENT DOCUMENTS

| | | | | |
|---|---|---|---|---|
| 6,032,313 | A * | 3/2000 | Tsang | A46B 13/02 15/21.1 |
| 6,224,304 | B1 * | 5/2001 | Smith | B23B 31/201 279/150 |
| 7,052,382 | B2 * | 5/2006 | Baker | B23B 45/003 451/344 |
| 2005/0009458 | A1 * | 1/2005 | Uzumcu | B23D 47/126 451/359 |
| 2011/0039482 | A1 * | 2/2011 | Timmons | B24B 23/022 451/344 |

FOREIGN PATENT DOCUMENTS

| | | |
|---|---|---|
| CN | 202622501 | 12/2012 |
| CN | 103659506 | 3/2014 |
| CN | 203817985 | 9/2014 |
| CN | 204295449 | 4/2015 |
| CN | 105458939 | 4/2016 |
| CN | 205765335 | 12/2016 |

OTHER PUBLICATIONS

Notification of Grant for Chinese Counterpart Application 201810418629.6 dated Dec. 7, 2018.

* cited by examiner

WALL POLISHER FOR BUILDING DECORATION

CROSS-REFERENCES TO RELATED APPLICATIONS

The present application claims priority from Chinese application No. 2018104186296 filed on 2018 May 4 which is hereby incorporated by reference in its entirety.

TECHNICAL FIELD

The invention relates to the technical field of building decoration, in particular to a wall polisher for building decoration.

BACKGROUND OF THE INVENTION

In the field of building decoration, the wall surface of the building is often rough and uneven, which has a bad effect on subsequent plastering processes, such as painting or mud scraping, therefore the rough wall surface needs to be polished. If the rough wall surface is polished well, it will be convenient for the subsequent painting on the wall. However, the existing polishing operations are all conducted through a simple hand-held polishing machine held by the staff, and the rough and uneven wall surface is polished by controlling the polishing head, which leads to high labor intensity, waste of time and labor, and the wall surface is uneven after polishing, thereby affecting the polishing effect and accuracy. What's more, large dust will be produced during polishing, which will do damage to human body, and the spreading dust will lead to inconvenience in subsequent sweeping.

BRIEF SUMMARY OF THE INVENTION

The technical problem to be solved by the invention is to provide a wall polisher for building decoration, so as to overcome the problems existing in the prior art.

The following technical plan is adopted by the invention: a wall polisher for building decoration of this invention comprises a main body, a housing fixedly arranged on one end of said main body, a slot with an opening towards one end disposed in said housing, a handle fixedly set on the top end face of said main body, standing bases up and down symmetrically disposed on one end face of said main body, a pushing cushion which is fixedly connected to one end face of said main body arranged between two said standing bases; a dust collecting device which is dismountable disposed on the bottom of said housing, a hanging slot mounted on the bottom of one end face of said housing, a pushing assembly which pushes said dust collecting device arranged on the bottom end face of said main body, a polishing head arranged in said slot, wherein the bottom end wall of said slot is provided with a tilted slot; a drive device which is used for driving said polishing head to rotate arranged in said main body, wherein said drive device comprises a control cavity and a through hole which is communicated between said control cavity and said slot, a spindle rotatably mounted in said through hole through a bearing, wherein one end of said spindle extends towards one end into said slot and is fixedly connected with said polishing head, and the other end of said spindle extends towards the other end into said control cavity and is fixedly provided with a left bevel gear; wherein the upper end wall of said control cavity is provided with an upper sliding chute, and the lower end wall of said control cavity is provided with a lower sliding chute, wherein one end wall of said upper sliding chute is provided with a upper transversal slot, and one end wall of said lower sliding chute is provided with a lower transversal slot; a drive slot communicated between one end of said upper transversal slot and one end of said lower transversal slot, an upper matching slot and a lower matching slot up and down symmetrically arranged on one end wall of said control cavity, an upper slider which slides towards two ends arranged in said upper sliding chute, wherein said upper transversal slot is provided with an upper transverse block which slides towards two ends, and one end of said upper transverse block is integrated with said upper slider, wherein the other end of said upper transverse block extends towards one end into said drive slot and is integrated with an upper connection block which extends downward, wherein the bottom end face of said upper connection block is fixedly provided with an upper rack; a lower slider which slides towards two ends arranged in said lower sliding chute, wherein said lower transversal slot is provided with a lower transverse block which slides towards two ends and one end of which is integrated with said lower slider, wherein one end of said lower transverse block extends towards one end into said drive slot and is integrated with a lower connection block which extends upward, and the top end face of said lower connection block is fixedly provided with a lower rack; a power assembly arranged between said upper rack and said lower rack as well as at the middle of said drive slot, a rotating motor embedded in the bottom end face of said upper slider, wherein an output shaft of said rotating motor extends downward into said control cavity and is fixedly provided with a right bevel gear which is opposite to said upper matching slot and is used for engaging with said left bevel gear; wherein the top end face of lower slider, through a connecting rod, is fixedly provided with a fixed bevel gear which is opposite to said lower matching slot and is used for engaging with said left bevel gear.

Further technical proposal, said power assembly comprises a drive gear which is rotatably arranged through a rotating shaft and engages with said upper rack and said lower rack, wherein said drive gear is fixedly connected to said rotating shaft, wherein the rear end of said rotating shaft is in power connection with said drive motor which is set on the rear end wall of said drive slot, and the front end of said rotating shaft is in rotational engagement with the front end wall of said drive slot.

Further technical proposal, said dust collecting device comprises a box body, a collecting tank which has an upward opening and is used for being communicated with said tilted slot arranged in said box body, wherein one side of the top end face of said box body is provided with a hanging plate, and said box body and said hanging plate are formed into a one-piece structure, wherein one end face of said hanging plate is fixedly provided with a hanging block which is used for coupling with said hanging slot, wherein the periphery of one end face of said hanging block is provided with a guide bevel, wherein said collecting tank is hemispherical.

Further technical proposal, said pushing assembly comprises a pushing sliding chute, a pushing sliding plate which slides towards two ends and extends downward mounted in said pushing sliding chute, a grab handle fixedly disposed on one end face of said pushing sliding plate, a pushing spring slot arranged on one end wall of said pushing sliding chute, wherein said pushing sliding chute is provided with a guide rod which extends towards two ends and penetrates through said pushing sliding plate and is in sliding fit connection with said pushing sliding plate, wherein one end of said guide rod is fixedly connected with one end wall of said pushing sliding chute, and the other end of said guide rod is fixedly connected with the other end wall of said pushing sliding chute; a pushing spring which is used for pushing said pushing sliding plate towards one side wound around said guide rod, wherein one end of said pushing spring is fixedly connected to one end face of said pushing sliding plate, and the other end of said pushing spring is fixedly connected to one end wall of said pushing spring slot.

Further technical proposal, the respective volumes of said left bevel gear, right bevel gear and fixed bevel gear are the same, and one end face of said polishing head is in the same plane as one end face of said housing.

Further technical proposal, said upper connection block, said upper slider and said upper transverse block are formed into a one-piece structure, and said lower connection block, said lower slider and said lower transverse block are also formed into a one-piece structure.

The benefits of the invention are as follows:

1. Said housing is attached to the rough wall surface by applying a pushing force to said pushing cushion, and at this time said polishing head is also attached to the rough wall surface; after that, said drive motor is controlled to operate to drive said rotating shaft to rotate to drive said drive gear to rotate, and said drive gear is rotated to simultaneously drive said upper connection block to slide towards one side and drive said lower connection block to slide towards the other side; said upper connection block 51 sliding towards one side pushes said upper slider and said upper transverse block to slide towards one side, which drives said rotating motor and said right bevel gear to slide towards one side, so that said right bevel gear engages with said left bevel gear; while said lower connection block slides towards the other side to drive said lower slider and said lower transverse block to slide towards the other side; said lower slider sliding towards the other side drives said fixed bevel gear to move towards the other side to disengage from said left bevel gear, thereby making said left bevel gear unlocked; and then said rotating motor is controlled to operate to drive said right bevel gear to rotate to drive said left bevel gear to rotate, and said polishing head is driven to rotate through said spindle, so that the rough wall surface is polished by said polishing head; while, through said tilted slot, the dust which is produced during polishing drops into and is collected by said collecting tank, which prevents the dust from spreading to pollute environment.

2. Said polishing head is locked and unable to rotate by said left bevel gear engaging with said fixed bevel gear, which prevents the polishing head from rotating when it is not use, in case casualty accidents happen; the dust in said collecting tank may be cleaned off only if the dust collecting device is disassembled; the dust collecting device is locked through pushing assembly, which prevents dust collecting device from dropping. Therefore, the overall operation of the device is safe and reliable.

3. This invention has a simple structure and a low cost on machining and maintaining, so that it will realize the automatic polishing operation on the rough wall surface, which improves the work efficiency of polishing, decreases the labor intensity of the staff and increases the flatness of wall surface polishing and stability during polishing, moreover, this device prevents staff from breathing in too much dust to be healthy; In addition, the whole device is compact in structure and reliable in operation.

BRIEF DESCRIPTION OF THE DRAWINGS

For better description, the present invention is described in detail by the following specific embodiments and drawings.

DETAILED DESCRIPTION OF THE INVENTION

Figure 1:
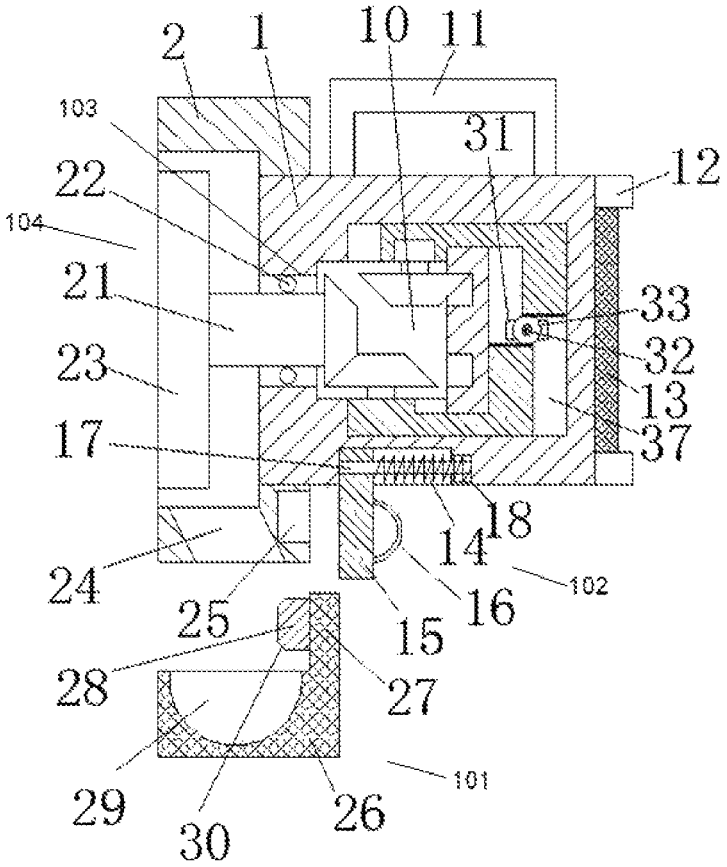
FIG. 1 is the overall structural diagram of a wall polisher for building decoration in this invention.
Figure 2:
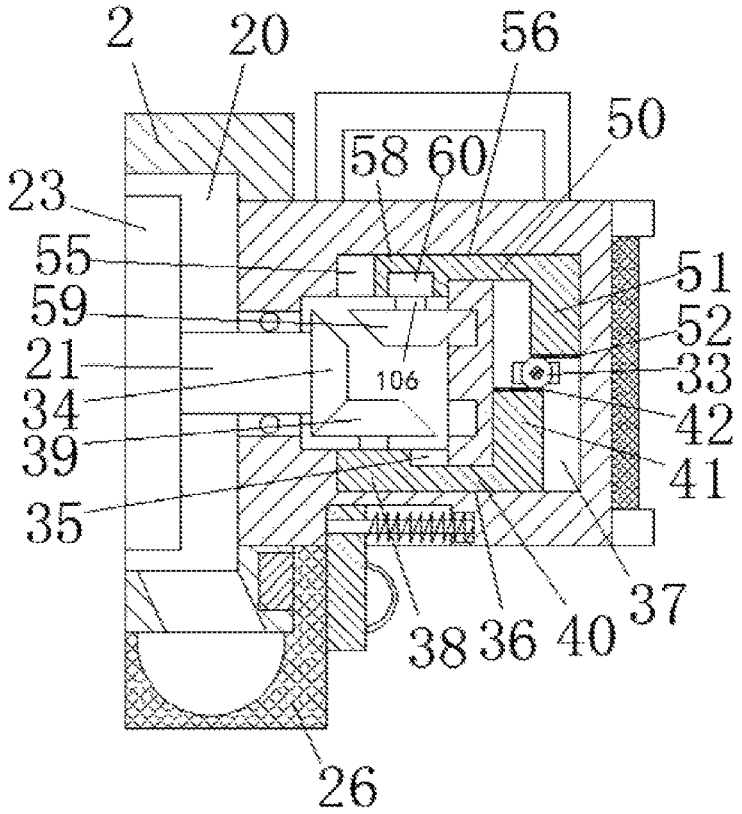
FIG. 2 is the overall schematic structural diagram of a wall polisher for building decoration when the dust collecting device in FIG. 1 is installed.
Figure 3:
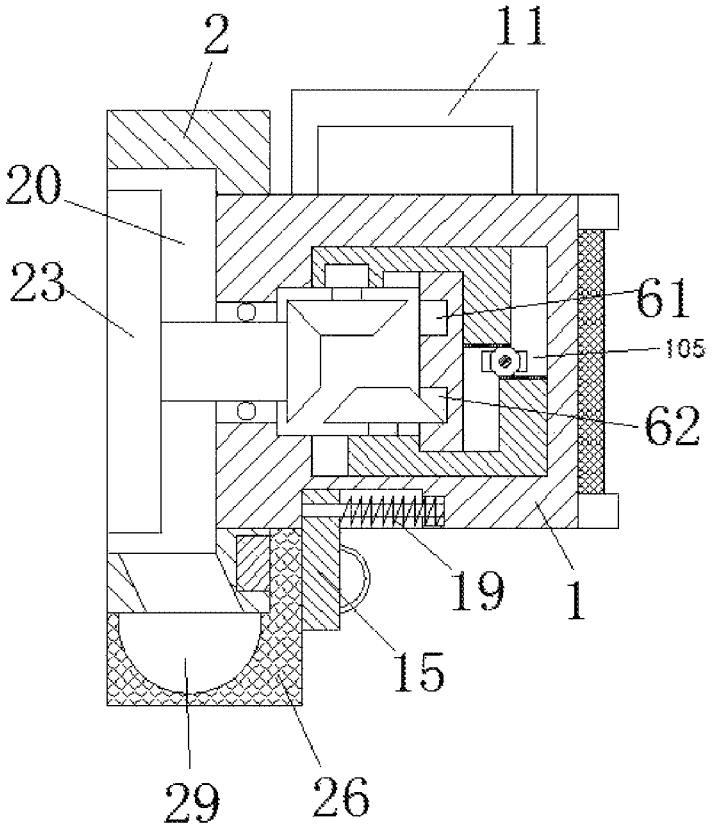
FIG. 3 is the schematic structural diagram of the polishing head in FIG. 2 under the condition of being driven.
Figure 4:
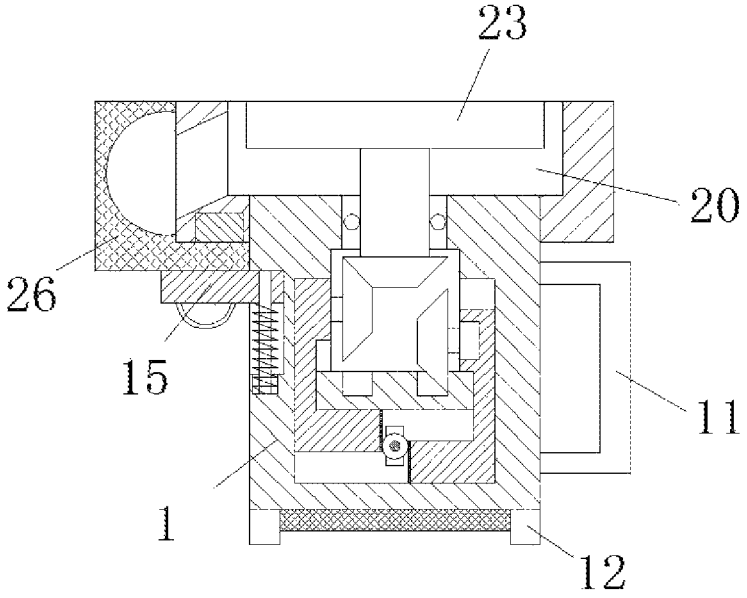
FIG. 4 is the schematic structural diagram of a wall polisher for building decoration when the device is not in use.

Referring to FIG. 1 to FIG. 4, a wall polisher for building decoration of this invention comprises a main body 1, a housing 2 fixedly arranged on one end of said main body 1, a slot 20 with an opening towards one end disposed in said housing 2, a handle 11 fixedly set on the top end face of said main body 1, standing bases 12 up and down symmetrically disposed on one end face of said main body 1, a pushing cushion 13 which is fixedly connected to one end face of said main body 1 arranged between two said standing bases 12; a dust collecting device 101 which is dismountable disposed on the bottom of said housing 2, a hanging slot 25 mounted on the bottom of one end face of said housing 2, a pushing assembly 102 which pushes said dust collecting device 101 arranged on the bottom end face of said main body 1, a polishing head 23 arranged in said slot 20, wherein the bottom end wall of said slot 20 is provided with a tilted slot 24; a drive device 104 which is used for driving said polishing head 23 to rotate arranged in said main body 1, wherein said drive device 104 comprises a control cavity 10 and a through hole 103 which is communicated between said control cavity 10 and said slot 20, a spindle 21 rotatably mounted in said through hole 103 through a bearing 22, wherein one end of said spindle 21 extends towards one end into said slot 20 and is fixedly connected with said polishing head 23, and the other end of said spindle 21 extends towards the other end into said control cavity 10 and is fixedly provided with a left bevel gear 34; wherein the upper end wall of said control cavity 10 is provided with an upper sliding chute 55, and the lower end wall of said control cavity 10 is provided with a lower sliding chute 35, wherein one end wall of said upper sliding chute 55 is provided with an upper transversal slot 56, and one end wall of said lower sliding chute 35 is provided with a lower transversal slot 36; a drive slot 37 communicated between one end of said upper transversal slot 56 and one end of said lower transversal slot 36, an upper matching slot 61 and a lower matching slot 62 up and down symmetrically arranged on one end wall of said control cavity 10, an upper slider 58 which slides towards two ends arranged in said upper sliding chute 55, wherein said upper transversal slot 56 is provided with an upper transverse block 50 which slides towards two ends, and one end of said upper transverse block 50 is integrated with said upper slider 58, wherein the other end of said upper transverse block 50 extends towards one end into said drive slot 37 and is integrated with an upper connection block 51 which extends downward, wherein the bottom end face of said upper connection block 51 is fixedly provided with an upper rack 52; a lower slider 38 which slides towards two ends arranged in said lower sliding chute 35, wherein said lower transversal slot 36 is provided with a lower transverse block 40 which slides towards two ends and one end of which is integrated with said lower slider 38, wherein one end of said lower transverse block 40 extends towards one end into said drive slot 37 and is integrated with a lower connection block 41 which extends upward, and the top end face of said lower connection block 41 is fixedly provided with a lower rack 42; a power assembly 105 arranged between said upper rack 52 and said lower rack 42 as well as at the middle of said drive slot 37, a rotating motor 60 embedded in the bottom end face of said upper slider 58, wherein an output shaft 106 of said rotating motor 60 extends downward into said control cavity 10 and is fixedly provided with a right bevel gear 59 which is opposite to said upper matching slot 61 and is used for engaging with said left bevel gear 34; wherein the top end face of said lower slider 38 through a connecting rod is fixedly provided with a fixed bevel gear 39 which is opposite to said lower matching slot 62 and is used for engaging with said left bevel gear 34.

Wherein, said power assembly 105 comprises a drive gear 33 which is rotatably arranged through a rotating shaft 32 and engages with said upper rack 52 and said lower rack 42, wherein said drive gear 33 is fixedly connected to said rotating shaft 32, wherein the rear end of said rotating shaft 32 is in power connection with said drive motor 31 which is set on the rear end wall of said drive slot 37, and the front end of said rotating shaft 32 is in rotational engagement with the front end wall of said drive slot 37.

Wherein, said dust collecting device 101 comprises a box body 26, a collecting tank 29 which has an upward opening and is used for being communicated with said tilted slot 24 arranged in said box body 26, wherein one side of the top end face of said box body 26 is provided with a hanging plate 27, and said box body 26 and said hanging plate 27 are formed into a one-piece structure; wherein one end face of said hanging plate 27 is fixedly provided with a hanging block 28 which is used for coupling with said hanging slot 25, wherein the periphery of one end face of said hanging block 28 is provided with a guide bevel 30, wherein said collecting tank 29 is hemispherical.

Wherein, said pushing assembly 102 comprises a pushing sliding chute 14, a pushing sliding plate 15 which slides towards two ends and extends downward mounted in said pushing sliding chute 14, a grab handle 16 fixedly disposed on one end face of said pushing sliding plate 15, a pushing spring slot 18 arranged on one end wall of said pushing sliding chute 14, wherein said pushing sliding chute 14 is provided with a guide rod 17 which extends towards two ends and penetrates through said pushing sliding plate 15 and is in sliding fit connection with said pushing sliding plate 15, wherein one end of said guide rod 17 is fixedly connected with one end wall of said pushing sliding chute 14, and the other end of said guide rod 17 is fixedly connected with the other end wall of said pushing sliding chute 14; a pushing spring 19 which is used for pushing said pushing sliding plate 15 towards one side wound around said guide rod 17, wherein one end of said pushing spring 19 is fixedly connected to one end face of said pushing sliding plate 15, and the other end of said pushing spring 19 is fixedly connected to one end wall of said pushing spring slot 18.

Wherein, the respective volumes of said left bevel gear 34, right bevel gear 59 and fixed bevel gear 39 are the same, and one end face of said polishing head 23 is in the same plane as one end face of said housing 2.

Wherein, said upper connection block 51, said upper slider 58 and said upper transverse block 50 are formed into a one-piece structure, and said lower connection block 41, said lower slider 38 and said lower transverse block 40 are also formed into a one-piece structure.

In the initial state, said left bevel gear 34 engages with said fixed bevel gear 39, and said polishing head 23 is locked and unable to rotate.

When the device is used, said pushing sliding plate 15 is first pulled to one side through said grab handle 16, and then said hanging block 28 is inserted into said hanging slot 25 and couples with said hanging slot 25, which makes the top end face of said box body 26 touch against the bottom end face of said housing 2, thereby making said collecting tank 29 communicated with said tilted slot 24, and then said grab handle 16 is released; said pushing sliding plate 15 pushes said hanging plate 27 under the elastic action of said pushing spring 19, thereby locking the position where said box body 26 is, and then said handle 11 is held by hand and said housing 2 is attached to the rough wall surface by applying a pushing force to said pushing cushion 13, and at this time, said polishing head 23 is also attached to the rough wall surface; after that, said drive motor 31 is controlled to operate to drive said rotating shaft 32 to rotate to drive said drive gear 33 to rotate, and said drive gear 33 is rotated to simultaneously drive said upper connection block 51 to slide towards one side and drive said lower connection block 41 to slide towards the other side; said upper connection block 51 sliding towards one side pushes said upper slider 58 and said upper transverse block 50 to slide towards one side, and then said rotating motor 60 and said right bevel gear 59 are driven to slide towards one side, so that said right bevel gear 59 engages with said left bevel gear 34; while said lower connection block 41 slides towards the other side to drive said lower slider 38 and said lower transverse block 40 to slide towards the other side; said lower slider 38 sliding towards the other side drives said fixed bevel gear 39 to slide towards the other side to disengage from said left bevel gear 34, thereby making said left bevel gear 34 unlocked; and then said rotating motor 60 is controlled to operate to drive said right bevel gear 59 to rotate to drive said left bevel gear 34 to rotate, and said polishing head 23 is driven to rotate through said spindle 21, so that the rough wall surface is polished by said polishing head 23; while, through said tilted slot 24, the dust which is produced during polishing drops into and is collected by said collecting tank 29, which prevents the dust from spreading to pollute environment.

After polishing is completed, the device may not need to be used, and said drive motor 31 is controlled to operate to rotate reversely to drive said rotating shaft 32 to rotate, thereby driving said drive gear 33 to rotate, which simultaneously drives said upper connection block 51 to slide to one side and said lower connection block 41 to slide to the other side, so that the device is recovered to the initial position; after that, said left bevel gear 34 is meshed with said fixed bevel gear 39, and said polishing head 23 is locked and unable to rotate, which prevents said polishing head 23 from rotating when the device is not in use, while at this time, dust in said collecting tank 29 may be cleaned off only if the dust collecting device 101 is disassembled.

The benefits of the invention are as follows:

1. Said housing is attached to the rough wall surface by applying a pushing force to said pushing cushion, and at this time said polishing head is also attached to the rough wall surface; after that, said drive motor is controlled to operate to drive said rotating shaft to rotate to drive said drive gear to rotate, and said drive gear is rotated to simultaneously drive said upper connection block to slide towards one side and drive said lower connection block to slide towards the other side; said upper connection block 51 sliding towards one side pushes said upper slider and said upper transverse block to slide towards one side, which drives said rotating motor and said right bevel gear to slide towards one side, so that said right bevel gear engages with said left bevel gear; while said lower connection block slides towards the other side to drive said lower slider and said lower transverse block to slide towards the other side; said lower slider sliding towards the other side drives said fixed bevel gear to move towards the other side to disengage from said left bevel gear, thereby making said left bevel gear unlocked; and then said rotating motor is controlled to operate to drive said right bevel gear to rotate to drive said left bevel gear to rotate, and said polishing head is driven to rotate through said spindle, so that the rough wall surface is polished by said polishing head; while, through said tilted slot, the dust which is produced during polishing drops into and is collected by said collecting tank, which prevents the dust from spreading to pollute environment.

2. Said polishing head is locked and unable to rotate by said left bevel gear engaging with said fixed bevel gear, which prevents the polishing head from rotating when it is not in use, so as to avoid the casualty accidents; the dust in said collecting tank may be cleaned off only if the dust collecting device is disassembled; the dust collecting device is locked through pushing assembly, which prevents dust collecting device from dropping. Therefore, the overall operation of the device is safe and reliable.

3. This invention has a simple structure and a low cost on machining and maintaining, and it may realize the automatic polishing operation on the rough wall surface, which improves the work efficiency of polishing, decreases the labor intensity of the staff and increases the flatness of wall surface polishing and stability during polishing; moreover, this device prevents staff from breathing in too much dust to be unhealthy; In addition, the whole device is compact in structure and reliable in operation.

The above is only the specific embodiment of the invention, but the scope of the invention is not limited thereto, and any changes or substitutions that are not thought of by the creative work should fall into the claimed protection extent of this invention. Therefore, the claimed protection extent of the invention shall be determined with reference to the appended claims.

The invention claimed is:

1. A wall polisher for building decoration of this invention, comprising:

a main body, a housing fixedly arranged on one end of said main body, a slot with an opening towards one end disposed in said housing, a handle fixedly set on a top end face of said main body, standing bases up and down symmetrically disposed on one end face of said main body, a pushing cushion which is fixedly connected to one end face of said main body arranged between two said standing bases;

a dust collecting device which is dismountable disposed on a bottom of said housing, a hanging slot mounted on one bottom end face of said housing, a pushing assembly which pushes said dust collecting device arranged on the bottom end face of said main body, a polishing head arranged in said slot, wherein a bottom end wall of said slot is provided with a tilted slot;

a drive device which is used for driving said polishing head to rotate arranged in said main body, wherein said drive device comprises a control cavity and a through hole which is communicated between said control cavity and said slot, a spindle rotatably mounted in said through hole through a bearing, wherein one end of said spindle extends towards one end into said slot and is fixedly connected with said polishing head, and the other end of said spindle extends towards the other end into said control cavity and is fixedly provided with a left bevel gear;

wherein an upper end wall of said control cavity is provided with an upper sliding chute, and a lower end wall of said control cavity is provided with a lower sliding chute, wherein one end wall of said upper sliding chute is provided with a upper transversal slot, and one end wall of said lower sliding chute is provided with a lower transversal slot;

a drive slot communicated between one end of said upper transversal slot and one end of said lower transversal slot, an upper matching slot and a lower matching slot up and down symmetrically arranged on one end wall of said control cavity, an upper slider which slides towards two ends arranged in said upper sliding chute, wherein said upper transversal slot is provided with an upper transverse block which slides towards two ends, and on end of said upper transverse block is integrated with said upper slider, wherein the other end of said upper transverse block extends towards one end into said drive slot and is integrated with an upper connection block which extends downward, wherein a bottom end face of said upper connection block is fixedly provided with an upper rack;

a lower slider which slides towards two ends arranged in said lower sliding chute, wherein said lower transversal slot is provided with a lower transverse block which slides towards two ends and one end of which is integrated with said lower slider, wherein one end of said lower transverse block extends towards one end into said drive slot and is integrated with a lower connection block which extends upward, and a top end face of said lower connection block is fixedly provided with a lower rack;

a power assembly arranged between said upper rack and said lower rack as well as at the middle of said drive slot, a rotating motor embedded in a bottom end face of said upper slider, wherein an output shaft of said rotating motor extends downward into said control cavity and is fixedly provided with a right bevel gear which is opposite to said upper matching slot and is used for engaging with said left bevel gear;

wherein a top end face of lower slider, through a connecting rod, is fixedly provided with a fixed bevel gear which is opposite to said lower matching slot and is used for engaging with said left bevel gear;

wherein said rotating motor is controlled to operate to drive the right bevel gear to rotate to drive the left bevel gear to rotate, which drives the polishing head to rotate through a spindle, and the housing is attached on a rough wall surface with said handle held and the push force applied to said pushing cushion, and the rough wall surface is polished through the polishing head.

2. The wall polisher for building decoration according to claim 1, wherein said power assembly comprises a drive gear which is rotatably arranged through said rotating shaft and engages with said upper rack and said lower rack, wherein said drive gear is fixedly connected to said rotating shaft, wherein a rear end of said rotating shaft is in power connection with said drive motor which is set on the rear end wall of said drive slot, and a front end of said rotating shaft is in rotational engagement with the front end wall of said drive slot;

wherein the drive motor is controlled to operate to drive the rotating shaft to rotate, so that the drive gear is driven to rotate.

3. The wall polisher for building decoration according to claim 1, wherein said dust collecting device comprises a box body, a collecting tank which has an upward opening and is used for being communicated with said tilted slot arranged in said box body, wherein one side of the top end face of said box body is provided with a hanging plate, and said box body and said hanging plate are formed into a one-piece structure;

wherein one end face of said hanging plate is fixedly provided with a hanging block which is used for coupling with said hanging slot, wherein a periphery of one end face of said hanging block is provided with a guide bevel, wherein said collecting tank is hemispherical, and the dust produced during polishing is collected by the collecting tank through the tilted slot.

4. The wall polisher for building decoration according to claim 1, wherein said pushing assembly comprises a pushing sliding chute, a pushing sliding plate which slides towards two ends and extends downward mounted in said pushing sliding chute, a grab handle fixedly disposed on one end face of said pushing sliding plate, a pushing spring slot arranged on one end wall of said pushing sliding chute, wherein said pushing sliding chute is provided with a guide rod which extends towards two ends and penetrates through said pushing sliding plate and is in sliding fit connection with said pushing sliding plate, wherein one end of said guide rod is fixedly connected with one end wall of said pushing sliding chute, and the other end of said guide rod is fixedly connected with the other end wall of said pushing sliding chute;

a pushing spring which is used for pushing said pushing sliding plate towards one side wound around said guide rod, wherein one end of said pushing spring is fixedly connected to one end face of said pushing sliding plate, and the other end of said pushing spring is fixedly connected to one end wall of said pushing spring slot;

wherein the pushing sliding plate is pulled towards one side through a grab handle, and then said hanging block is inserted into said hanging slot and couples with the said hanging slot, which makes the top end face of the box body touch against the bottom end face of the housing, thereby making the collecting tank communicated with the tilted slot, and then, through releasing the grab handle, the pushing sliding plate pushes the hanging plate under the elastic force of the pushing spring, which locks the position where the box body is.

5. The wall polisher for building decoration according to claim 1, wherein respective volumes of said left bevel gear, right bevel gear and fixed bevel gear are the same, and one end face of said polishing head is in the same plane as one end face of said housing.

6. The wall polisher for building decoration according to claim 1, wherein said upper connection block, said upper slider and said upper transverse block are formed into a one-piece structure, and said lower connection block, said lower slider and said lower transverse block are also formed into a one-piece structure.

* * * * *